US006129041A

United States Patent [19]

Maiworm et al.

[11] Patent Number: 6,129,041

[45] Date of Patent: Oct. 10, 2000

[54] APPARATUS FOR MASKING FASTENER HOLES IN A WHEEL

[75] Inventors: Friedhelm Maiworm, Werdohl; Gottfried Graf, Philippsburg, both of Germany

[73] Assignee: Stahlschmidt und Maiworm GmbH, Bad Duerkheim, Germany

[21] Appl. No.: 09/007,884

[22] Filed: Jan. 15, 1998

[30] Foreign Application Priority Data

Jan. 15, 1997 [DE] Germany ..... 197 01 194

[51] Int. Cl.[7] ..... B05C 13/02

[52] U.S. Cl. ..... 118/500; 118/504; 118/505

[58] Field of Search ..... 118/500, 504, 118/505

[56] References Cited

U.S. PATENT DOCUMENTS 4,879,158 11/1989 Horiki et al. ..... 118/505

5,270,085 12/1993 Horiki et al. ..... 118/505

5,753,042 5/1998 Bauer ..... 118/505

*Primary Examiner*—Laura Edwards

*Attorney, Agent, or Firm*—Herbert L. Lerner; Laurence A. Greenberg; Werner H. Stemer

[57] ABSTRACT

When motor vehicle wheels are subjected to a coating process, the fastener holes must be masked. Masking elements are inserted into pilot holes of the fastener holes for masking the fastener holes during the coating process. The masking elements are such that they a form-locked in the respective pilot hole. In the apparatus in accordance with the invention a controlled swivel arm with a feed hopper is provided for feeding each masking element to the pilot hole of the fastener hole. After the coating process the masking element is removed from the pilot hole by swivel movement of the wheel, such that the masking element drops out of the pilot hole.

10 Claims, 2 Drawing Sheets

APPARATUS FOR MASKING FASTENER HOLES IN A WHEEL

BACKGROUND OF THE INVENTION

Field of the Invention

The invention relates to a method for masking fastener holes in a wheel, more particularly a light-alloy wheel, whereby masking elements are inserted in a pilot hole of the fastener hole to mask the fastener holes during a coating process. Furthermore, the invention relates to a apparatus for implementing such a method.

A variety of coating processes are employed in the manufacture of vehicle wheels. The coatings are provided particularly for improving corrosion protection. The fastener holes in the wheels must be masked for this purpose, since the wheel fasteners may otherwise come loose on the road. This is the reason why masking elements are manually inserted into the fastener holes, and manually removed later upon completion of the coating process. For this purpose more particularly peg-type masking elements are used shaped for facilitated manual handling. The process of inserting and removing the masking elements manually is quite labor intensive and thus results in increased production costs.

SUMMARY OF THE INVENTION

It is accordingly an object of the invention to provide a method and device for masking fastener holes in a wheel, which overcomes the above-mentioned disadvantages of the prior art devices and methods of this general type and which reduces production cost and man-hour requirements.

With the foregoing and other objects in view there is provided, in accordance with the invention, a method for masking fastener holes in the manufacture of motor vehicle wheels, which comprises:

- orienting a motor vehicle wheel, such as a light-alloy wheel, with fastener holes and corresponding pilot holes substantially horizontally;
- inserting masking elements into the pilot holes with an automatic feeder and masking the fastener holes with the masking elements during a coating process; and
- subsequent to the coating process, removing the masking elements from the pilot hole by swiveling the wheel out of the horizontal orientation.

In brief, the method comprises the steps of: orienting the wheel substantially horizontally, inserting a masking element into each pilot hole with a feeder, locating the masking element positively (in form lock) in the pilot hole and removing the masking element from the pilot hole on completion of the coating process by swiveling the wheel.

The novel method does away with having to insert and remove the masking elements manually, since these are automatically fed by the feeder and removed on completion of the coating process by turning the wheel over. Due to their adapted dimensions the masking elements are held in the pilot hole by their own weight and thus the masking elements mask the fastener holes during the coating process.

In accordance with an added mode of the invention, a number and arrangement of the fastener holes of the wheel are ascertained with a measuring device, and the feeder is controlled in the inserting step as a function of values measured with the measuring device. As a result, a wide variety of different wheel types can be provided with masking elements within a single system.

In accordance with an additional feature of the invention, the wheels are transported to the feeder with a conveyor system, and wherein the inserting step comprises inserting the masking elements while the wheels are continuously transported by the conveyor system. This permits continuous operation of the system.

In accordance with another feature of the invention, the masking elements are returned to the feeder after removal from the pilot holes on completion of the coating process. The masking element can thus be put to continuous and repeated use.

In accordance with again an added feature of the invention, the method further comprises cleaning the masking elements and removing a coating from the masking elements prior to their being returned to the feed hopper, i.e., during their return to the feeder or prior to the return.

With the above and other objects in view there is also provided, in accordance with the invention, an apparatus for masking fastener holes in the manufacture of motor vehicle wheels, such as light-alloy wheels. The apparatus comprises:

- masking elements adapted to be form-lockingly disposed in respective pilot holes of a motor vehicle wheel prior to a coating process;
- a controlled swivel arm disposed at a path along which the motor vehicle wheel is transported towards a coating unit, the controlled swivel arm having a feed hopper at a free end thereof for feeding and inserting individual masking elements in respective pilot holes one at a time.

It is possible with the novel apparatus to automatically feed a masking element to each pilot hole of the wheel, whereby the masking elements are positively retained in the pilot hole. During the subsequent coating process the corresponding fastener hole is thus masked by the masking element. The masking elements are transported by the feed hopper at the free end of a robot arm and dropped into the pilot holes.

In accordance with yet an additional feature of the invention, there is provided a storage bin for the masking elements, and a flexible connecting hose connected between the storage bin and the feed hopper for transporting the masking elements from the storage bin to the feed hopper. Pneumatic air transport thus finds expedient application in this context.

In accordance with yet another feature of the invention, there is provided a process control computer for advancing the feed hopper to the fastener holes.

In accordance with again another feature of the invention, there is provided a measuring device (e.g. an optical sensor) for sensing a number and an arrangement of fastener holes formed in the wheel disposed along the path, the measuring device being connected to and outputting measured values to the process control computer, whereupon the process control computer advances the feed hopper to the fastener holes as a function of the measured values.

Various types of wheels can be provided with masking elements on a single system. Expediently the measuring device is coupled to a process control computer in which the characteristic data of the manufactured wheels is memorized. By comparing the measured values sensed by the measuring device to the stored characteristic data each wheel can thus be identified.

In accordance with another feature of the invention, there is provided a conveyor system for transporting the wheel from the measuring device to the swivel arm, i.e., to the feeder.

In accordance with again an additional feature of the invention, the conveyor system comprises separate support elements for each wheel, each of the support elements including a spindle onto which a central hole of the wheel is placed. Each support element expediently comprises a mounting plate for the wheel, in the center of which the spindle is located.

In accordance with yet again an additional feature of the invention, there is provided a transfer unit receiving the wheel from the coating unit, the transfer unit swiveling the wheel such that the masking elements drop out of the pilot holes of the fastener holes by force of gravity. The elements may thereby be collected in a collection through.

In accordance with a concomitant feature of the invention, there is provided a return device for returning the masking elements to the feeder after having been removed from the wheel. If necessary, a cleaning station may be interposed to remove the coatings from the masking elements.

Other features which are considered as characteristic for the invention are set forth in the appended claims.

Although the invention is illustrated and described herein as embodied in a method and apparatus for masking fastener holes in a wheel, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
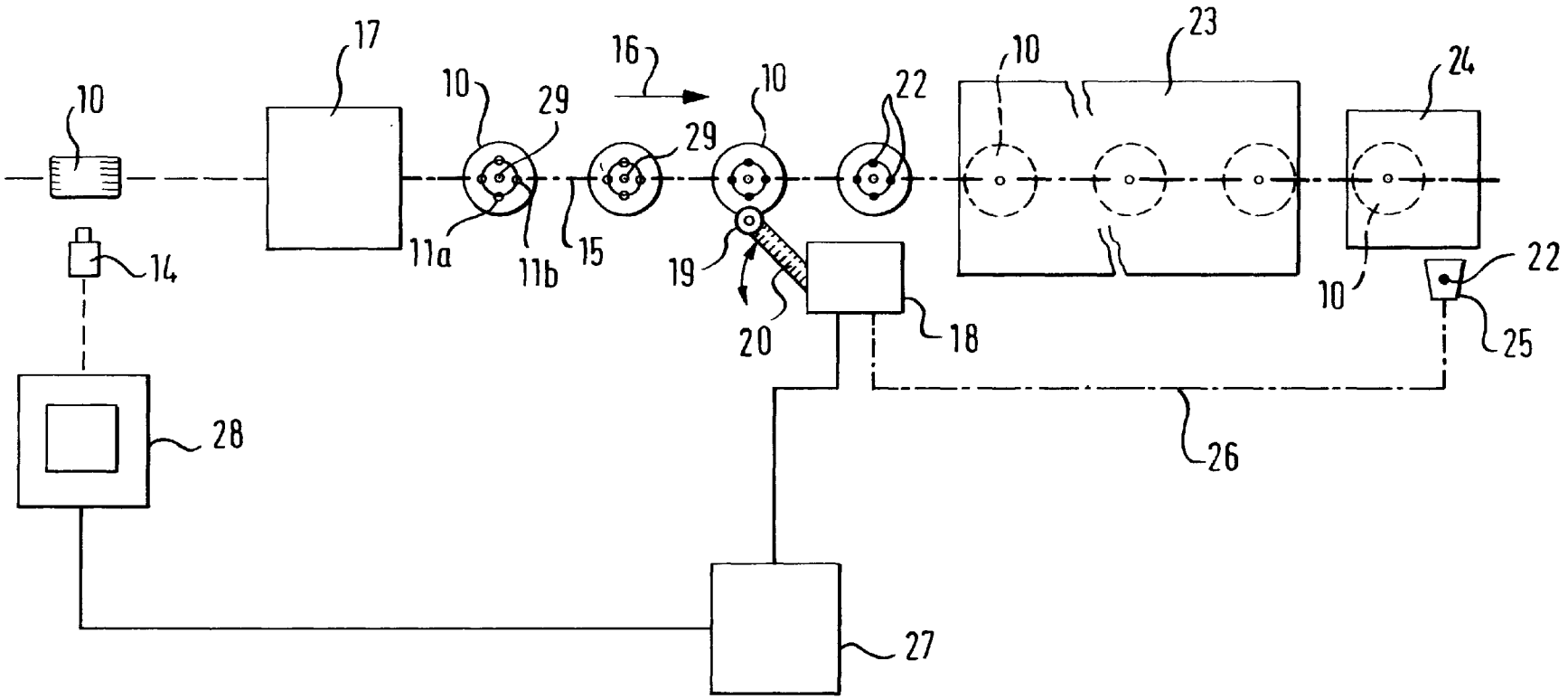
FIG. 1 is a sequential flow chart of a manufacturing station with an apparatus according to the invention.

Referring now to the figures of the drawing in detail and first, particularly, to FIG. 1 thereof, there is seen a schematic system view including a coating unit 23 for wheels 10 in which the wheels 10 are subjected to a coating process.

The system as shown comprises a measuring device 14 for sensing the number and the relative configuration of fastener holes 11*a*, 11*b* of the wheel 10. The wheel 10 is oriented vertically in this device so that the fastener holes 11*a*, 11*b* face the measuring device 14. The measuring device 14 transmits measurement data to an identification means 28 in which the characteristic data of the manufactured wheels 10 are memorized. The result of the evaluation is then forwarded to the process control computer 27 connected to the identification means 28.

The wheel 10 is subsequently transferred to a conveyor system 15 by means of a transfer unit 17. The conveyor system 15 comprises a plurality of mutually spaced-apart spindles 29 (i.e., peg-type supporting elements 29) which can be introduced into a central hole 13 of the wheel 10.

Furthermore, a feeder 18 is provided with which spherical masking elements 22 are automatically fed to the fastener holes 11*a*, 11*b*. For this purpose, the feeder 18 comprises a swivel arm 20 at a free end of which there is provided a feed hopper 19. The feeder 18 is controlled by the process control computer 27. The feed hopper 19 is advanced to the fastener holes on the basis of the measurement data provided by the measuring device 14.

After each of the fastener holes has been masked by a masking element 22 the conveyor system 15 transports the wheels 10 into the coating unit 23.

A transfer unit 24 downstream of the coating unit 23, relative to the travel direction of the wheels, removes the wheel 10 from the conveyor system 15. The wheel is subjected to a swivel movement and, as a result, the masking elements 22 drop out of the pilot holes 12 by the force of gravity. The elements 22 are caught and collected in a collecting trough 25. The masking elements may be returned to the feeder 18 via a return conveyor 26.

Figure 2:
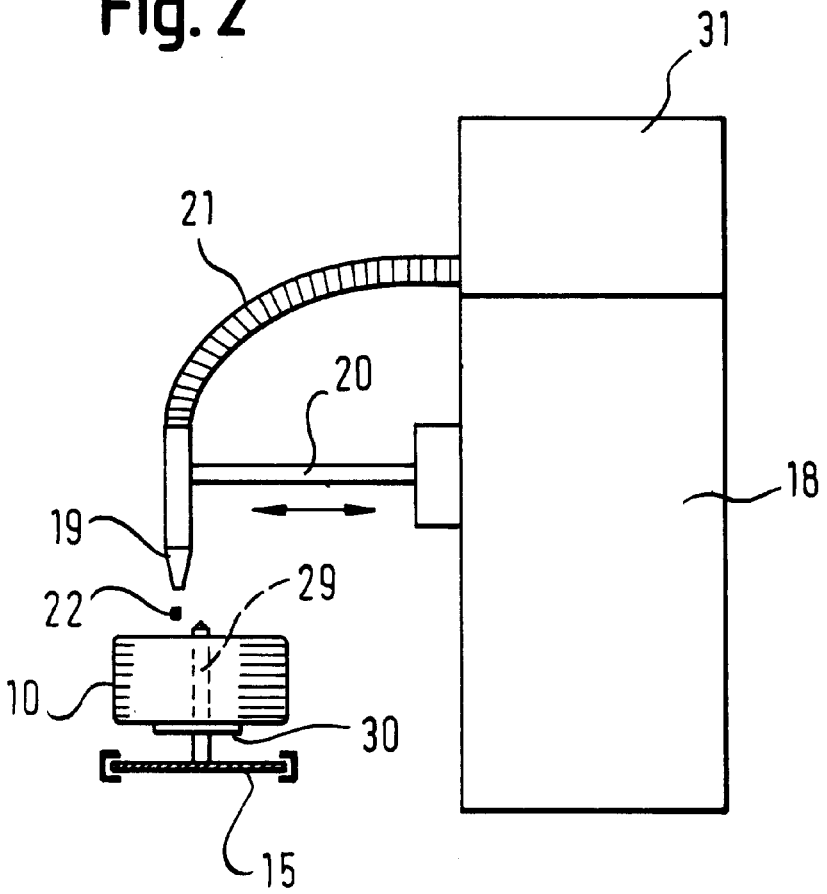
FIG. 2 is a side view of a masking element feeder.
Figure 3:
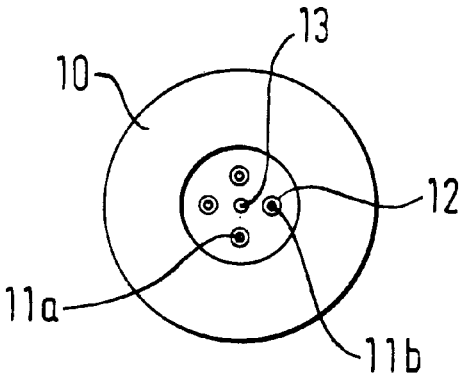
FIG. 3 is a plan view of a wheel including masking elements disposed in the fastener holes.

Referring now to FIG. 2, there is shown in a lateral view of the feeder 18 from which the swivel arm 20 projects laterally.

A non-illustrated drive moves the swivel arm 20 in three directions. The swivel arm 20, therefore, is a 3-D motion robot arm. The masking elements 22 are fed to the hopper 19 (dispenser) via a feeder hose 21 which is connected to a storage bin 31 for the masking elements 22.

During the transport by the conveyor system 15 the spindle 29 engages the central hole 13 of the wheel 10. The underside of the wheel 10 is supported on a mounting plate 30.

The masking elements 22 are spherical or ellipsoidal balls which are advanced by means of the traveling feed hopper 19 to the pilot holes 12 of the wheel 10. There, the masking elements 22 drop from the feed hopper 19 into the corresponding pilot holes 22. Due to their own weight the masking elements 22 reliably remain located in the pilot hole 12 during the subsequent coating process.

The function of the above-described apparatus will now be explained in detail:

First, by means of the measuring device 14 and the assigned identification means 28 the number and the relative arrangement of the fastener holes 11*a*, 11*a* of the wheel 10 are ascertained. The results of the measurement are then signaled to the process control computer 27. By means of the transfer unit 17 the wheel 10 is then transferred to the conveyor system 15, the wheel 10 being engaged by the transfer unit 17 and mounted on the spindle 29. The wheels 10 are transported on the conveyor system 15 in a horizontal transport position (with the rotary axis of the wheel vertical).

By means of the conveyor system 15 the wheels are conveyed to the feeder 18 in the direction shown by the arrow 16. There, spherical masking elements 22 are inserted in the pilot holes of the wheels 10. The masking elements 22 are fed by means of the feed hopper 19 on the free end of the swivel arm 20. The swivel arm 20 is controlled by the process control computer 27 on the basis of the sensed measured values of the wheel 10.

The masking elements 22 may be fed in continuous operation of the conveyor system 15. Once all fastener holes 11*a*, 11*b* have been provided with masking elements 22, the wheel 10 is subjected to a coating process in the coating unit 23, the masking elements 22 masking the fastener holes 11*a*, 11*b* thus preventing coating in the region of the fastener holes 11*a*, 11*b*.

After they leave the coating unit 23, the wheels 10 are removed from the conveyor system 15 by means of a transfer unit 24. The transfer unit 24 swivels the wheels 10 such that the masking elements 22 drop out of the pilot holes 12 by their own weight into a collecting trough 25. The masking elements are thereafter returned via a returning means 26 to the feeder 18.

Where necessary, a cleaning process may be interposed for the masking elements 22.

The method for masking fastener holes as hitherto described eliminates labor-intensive manual feed and removal of masking elements to and from the fastener holes 11*a*, 11*b*. As a result, the operating costs of such a system are reduced.

We claim:

1. An apparatus for masking fastener holes in the manufacture of motor vehicle wheels to be coated, wherein the wheels are formed with fastener holes and corresponding pilot holes, the apparatus which comprises:

masking elements for disposal in respective pilot holes of a motor vehicle wheel prior to a coating process;

a controlled swivel arm disposed at a path along which the motor vehicle wheel is transported towards a coating unit, said controlled swivel arm having a feed hopper at a free end thereof for feeding and inserting individual masking elements in respective pilot holes one at a time.

2. The apparatus according to claim 1, wherein each of said masking elements are a round masking element having a shape selected from the group of shapes consisting of spherical and ellipsoidal.

3. The apparatus according to claim 1, which further comprises a storage bin for said masking elements, and a flexible connecting hose connected between said storage bin and said feed hopper for transporting said masking elements from said storage bin to said feed hopper.

4. The apparatus according to claim 1, which further comprises a process control computer for controlling movement of said feed hopper to said fastener holes.

5. The apparatus according to claim 4, which further comprises a measuring device for sensing a number and an arrangement of fastener holes formed in the wheel disposed along the path, said measuring device being connected to and outputting measured values to said process control computer, whereupon said process control computer advances said feed hopper to said fastener holes as a function of the measured values.

6. The apparatus according to claim 5, wherein said measuring device is at least one optical sensor.

7. The apparatus according to claim 5, which comprises a conveyor system for transporting the wheel from said measuring device to said swivel arm.

8. The apparatus according to claim 7, wherein said conveyor system comprises separate support elements for each wheel, each of said support elements including a spindle onto which a central hole of the wheel is placed.

9. The apparatus according to claim 1, which further comprises the coating unit and a transfer unit disposed at a path along which the wheel is transported away from the coating unit to receive the wheel from the coating unit, said transfer unit swiveling the wheel such that said masking elements drop out of the pilot holes of said fastener holes by force of gravity.

10. The apparatus according to claim 1, which further comprises a return device communicating with said feed hopper for returning said masking elements to said feed hopper after having been removed from the wheel.

* * * * *